US006520447B2

(12) United States Patent
Kaipf et al.

(10) Patent No.: US 6,520,447 B2
(45) Date of Patent: Feb. 18, 2003

(54) REELING MACHINE FOR CONTINUOUS WINDING OF A FIBROUS WEB

(75) Inventors: Walter Kaipf, Haunsheim (DE); Rudolf Beisswanger, Steinheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 54 days.

(21) Appl. No.: 09/852,471

(22) Filed: May 10, 2001

(65) Prior Publication Data

US 2001/0040200 A1 Nov. 15, 2001

(30) Foreign Application Priority Data

May 11, 2000 (DE) ..... 100 23 057

(51) Int. Cl.[7] ..... B65H 18/26
(52) U.S. Cl. ..... 242/547; 242/542.3
(58) Field of Search ..... 242/542.3, 547

(56) References Cited

U.S. PATENT DOCUMENTS 3,389,450 A 6/1968 Robertson ..... 29/116

FOREIGN PATENT DOCUMENTS

| | | |
|---|---|---|
| AT | 345 657 | 9/1978 |
| CH | 559 141 | 2/1975 |
| DE | 88 08 823.5 | 10/1988 |
| DE | 44 01 804 A1 | 6/1994 |
| DE | 44 07 618 A1 | 9/1995 |
| DE | 296 13 554 U1 | 1/1998 |
| DE | 298 11 053 U1 | 10/1998 |
| DE | 91 17 272 U1 | 7/1999 |
| DE | 198 07 897 A1 | 8/1999 |
| DE | 198 48 532 A1 | 4/2000 |
| WO | WO 95/34495 | 12/1995 |
| WO | WO 98/52858 | 5/1998 |

*Primary Examiner*—John Q. Nguyen
(74) *Attorney, Agent, or Firm*—Taylor & Aust, P.C.

(57) ABSTRACT

A reeling machine is designed for continuous winding of fibrous web, in particular a paper or carton web, into a jumbo roll. An air squeeze arrangement is located in the lower area of the reeling machine which can be positioned against the jumbo roll and includes a positionable supporting profile with segmented rolls positioned eccentrically next to each other by means of bearings, whereby, the interior of the supporting profile is provided with a tube, which is surrounded by a guide pipe and filled with a pressure medium from a pressure source, upon which bearings are centrally supported by power transmission elements.

22 Claims, 2 Drawing Sheets

REELING MACHINE FOR CONTINUOUS WINDING OF A FIBROUS WEB

BACKGROUND OF THE INVENTION

1. Field of the Invention

The present invention relates to a reeling machine designed for continuous winding of a fibrous web, and more particularly for continuous winding of a paper or carton web.

2. Description of the Related Art

Reeling machines such as disclosed in European patent document EP 0 483 092 B1 or PCT document WO 98/52858 A1 (PR10706 WO), are used in machines designed for the manufacture or conversion of fibrous webs such as, paper or carton.

In today's modern winding designs, preparing to change a reel spool requires the spool with the virtually fully-wound jumbo roll ("wound roll") to be brought into a final position (reel spool changing position), in which there is no longer any active contact (the so-called "nip") between a reel drum and the jumbo roll. At this moment where there is no longer any nip, appropriate measures have to be employed to ensure that no air becomes trapped between the individual layers of the virtually fully-wound roll. It is also important to maintain the "wound-in" web tension so as to guarantee the desired winding quality even in the outer area of the roll. The problems inherent in this become more complex as the operating speed of the reeling machine increases (scale of 1500–2500 m/min) and where wound rolls with greater manufactured diameters are employed (scale of 2.5–4.5 m).

An attempt to solve this problem has already been made in a reeling machine of the type described above, as is manifest to the applicant from Unexamined German Patent Application DE 44 01 804 A1 (PR10035 DE). This document describes an arrangement comprising a rider roll with an elastic cover, which can be pressed against a jumbo roll separated from a reel drum by means of a pneumatic drive apparatus. The purpose of this arrangement is to limit the build up of trapped air between the individual layers of the jumbo roll and to maintain the "wound-in" web tension during a reel spool change. However, the rider roll suffers from a significant drawback in that it is subject to deflection due to its own weight, that the roll deviates from an ideal cylinder shape to a greater or lesser extent over the entire width due, for example, to varying paper thickness, and that the rider roll cannot therefore operate evenly over the whole width of the web on the surface contours of the virtually fully-wound jumbo roll. In consequence, it is impossible to completely avoid air being trapped between the outer layers of the virtually fully-wound roll. A further rider roll is known from German Patent Application DE 91 17 272 U1 in which the roll described also suffers from the same drawback mentioned above.

European patent document EP 0 714 373 (=WO 95/34495 A1) describes a process and an arrangement for depositing final web layers on a jumbo roll generated during the winding process in a reeling machine. In this process, an air squeeze arrangement is brought into active contact with the surface of the jumbo roll before the final web layers are deposited, whereupon the jumbo roll is moved into its change position whilst this active contact is maintained, thus enabling the desired strength of active contact to be retained for the purpose of avoiding the trapping of air between the individual layers of the roll. The element in the air squeeze arrangement, which presses onto the jumbo roll, is a pressing brush. Previous experiments have shown that the use of a brush can be disadvantageous in that a constant danger exists that the hairs of the brush will damage sensitive types of paper. Also, individual brush hairs may become detached and enter into the paper cycle as spurious components or brush hairs themselves may be damaged.

Furthermore, certain reeling machines are known in which there is no contact between the reel drum and the jumbo roll after each reel spool change, for the remainder of the winding process. In this arrangement an air squeeze apparatus, including an appropriate air squeeze element, is provided in the form of a rider roll operating continuously on the jumbo roll. A reeling machine of this type is known, for example, from German Patent Applications G 88 08 823.5 (=U.S. Pat. No. 5,249,758) and DE 298 11 053.

Both German Patent Applications cited above suffer from the drawback that a danger of deflection exists in broader paper or carton machines. The construction of the apparatus in accordance with cited document DE 298 11 053 U1 is both costly and complicated since it must be possible to position the point of support of the rider roll on the web, in the direction of winding, by a definable angle to the point where the web is wound on, while simultaneously maintaining a definable "pressing force" on the web that is spooled onto the reel spool.

SUMMARY OF THE INVENTION

The present invention provides an improved reeling machine in which the problem of trapped air between the individual layers of the jumbo roll, is avoided, thereby ensuring that the "wound-in" web tension is maintained and that sideways displacement of the individual layers of the jumbo roll is prevented.

In one embodiment of this invention a reeling machine is configured such that the air squeeze arrangement is composed of a positionable supporting profile with segmented rolls positioned next to each other by means of bearings. A tube surrounded by a guide pipe and filled with a pressure medium from at least one pressure source is provided in the interior of the supporting profile, and the non-rotating bearing bushings of the bearings are centrally supported on this tube by at least one power transmission element. This arrangement is advantageous in that any potential unevenness in the surface contours of the virtually fully-spooled jumbo roll can be countered by radial adjustment of the individual segmented rolls together with associated pressure compensation in the tube, thereby ensuring that no air is trapped between the individual layers of the jumbo roll while simultaneously maintaining the "wound-in" web tension. In addition, the technical construction of the air squeeze arrangement according to the invention produces a system, which is largely self-cushioning, and which reduces, to the greatest extent possible, any vibration induced by the web or the wound roll.

For reasons stemming from the demands of both printing technology and structural and manufacturing technology, the supporting profile mounted between the round bearing bushings of the bearings is composed of a supporting pipe, preferably a round supporting pipe.

The power transmission element may be a plunger, since it fulfils all requirements concerning functionality, serviceable life and is simple to produce in terms of the manufacturing technology required.

The pressure medium is a fluid, preferably a hydraulic fluid, or a gas. Both pressure media conform to state-of-the-art technology and both represent a cost-effective pressure medium suitable for a variety of operating conditions.

With regard to the air squeeze arrangement, it is advantageous for the segmented roll to have a diameter of between 200 and 400 mm, preferably between 250 and 350 mm, and a width of between 150 and 400 mm, preferably between 200 and 300 mm. These dimensions serve to ensure that the air squeeze arrangement does not subject the fibrous web to any kind of damage, such as grooving or other types of marking, or changes in its properties, such as shiners (shiny spots). With regard to avoiding the kinds of damage and changes in properties mentioned above, the arrangement may also include at least two segmented rolls placed directly next to each other at a distance of between 0.5 and 5 mm, preferably of between 1.0 and 2.0 mm.

Furthermore, for the purpose of avoiding the build-up of air in front of the air squeeze arrangement, it is advantageous for the segmented roll to have a rubberized and/or grooved surface. A rubberized surface of the segmented rolls should, by preference, have a hardness of between 50 and 200 P&J (Pussy & Jones), ideally between 80 and 120 P&J (Pussy & Jones).

To allow scope for rapid and marginal adjustment of the air squeeze arrangement the supporting profile is positioned eccentrically. The eccentric structure preferably features an eccentricity of between 2 and 20 mm, ideally between 5 and 12 mm, since this eccentricity can be achieved without any major additional structural complexity.

In order to avoid the emergence of trapped air between the individual layers of the jumbo roll, the air squeeze arrangement can be positioned against the jumbo roll at the point where the fibrous web meets the surface shell of the jumbo roll. Points before or after this contact point lead to reduced effectiveness with regard to the avoidance of trapped air.

In another embodiment of the invention the air squeeze arrangement is positioned against the jumbo roll in front of the opening of the nip between the reel drum and the jumbo roll, since the air squeeze arrangement can achieve the greatest possible efficiency in its action only when the nip is open.

The air squeeze arrangement is generally to be positioned in a linear fashion, preferably horizontally and/or vertically, and/or generally along the contour of a segment of a circle. These various application positions and movements offer practical advantages in terms of moving mass or changes in mass, as well as in terms of how they are regulated.

In a further embodiment of the invention an active area is formed between the jumbo roll and the air squeeze arrangement, the effective force applied in the active area can be adjusted through displacement of the air squeeze arrangement. This enables the achievement of a good winding result even for the last layers wound onto the roll. The jumbo roll is formed with a defined, evenly-wound tightness throughout the entire duration of the winding process, since the effective force in the active area between the jumbo roll and the air squeeze arrangement can be finely adjusted, even in the final phase of winding where there is no longer a nip between the Pope cylinder and the jumbo roll.

The specifications of the invention mentioned above are applicable not only in the various combinations given here, but also in other combinations or in isolation, without exceeding the scope of the invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention. in one form, and such exemplification is not to be construed as limiting the scope of the invention in any manner.

DETAILED DESCRIPTION OF THE INVENTION

Figure 1:
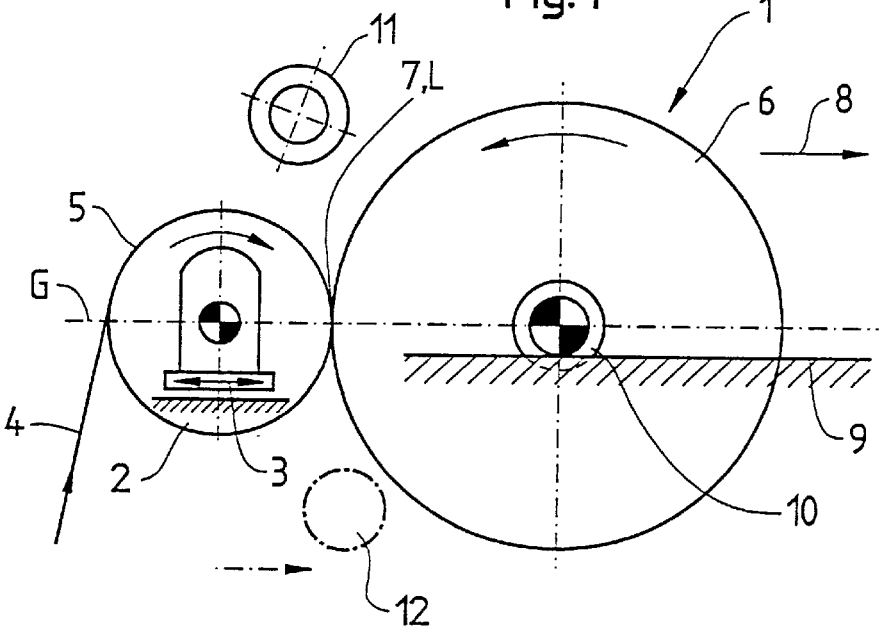
FIG. 1 is a schematic side view of a reeling machine, together with an air squeeze arrangement according to the invention, during the principal winding phase.

Referring now to the drawings, and more particularly to FIG. 1, there is shown reeling machine 1, including reel drum 2, also referred to as a press drum or doubling roll, which can either be rigidly positioned or, alternatively, displaced along theoretical horizontal line G, by means of a pressing apparatus not depicted in the drawing and which is driven by a driving mechanism, comprising a center drive mechanism in the case depicted. The various ways in which reel drum 2 may be displaced and moved have, in particular, been manifested to the applicant in Unexamined German Patent Application DE 198 07 897 A1 (PR10678 DE), the content of which is hereby incorporated by reference. Fibrous web 4 originates either from a calendar roller unit, which is not depicted here, or from the drying part of a paper or carton-making machine, also not depicted here. Fibrous web 4 is initially wound around an expander roll (not depicted here) before running onto surface shell 5 of reel drum 2 in the direction of arrow 'S' and then winding around surface shell 5 of reel drum 2 to a specified point where fibrous web 4 is detached from reel drum 2 onto jumbo roll 6. The detachment of fibrous web 4 from reel drum 2 and transfer to jumbo roll 6 is effected in nip 7, which develops during the principal winding phase between reel drum 2 and jumbo roll 6. Jumbo roll 6 is guided in the direction of movement shown by arrow 8 by means of a hoisting apparatus (not shown here) of a movable transport mechanism. The hoisting apparatus could be formed, for example, by a spindle drive comprising a threaded spindle driven by an electric motor. The transport mechanism serves to carry and guide reel spool 10 of jumbo roll 6, which is positioned on rails (guideway) 9. An arrangement to control longitudinal force L originating in nip 7 during the principal winding phase is known to the applicant from, for example, Unexamined German Patent Application DE 198 07 897 A1 (PR10678 DE) mentioned above. In the principal winding phase depicted in FIG. 1, empty reel spool 11 is held at a distance from reel drum 2 by a holding device not shown here ("ready position").

Air squeeze arrangement 12 (shown in dot-dash line format below jumbo roll 6) does not effect any action in connection with jumbo roll 6 during the principal winding phase depicted here. It is, instead, held in a waiting position. Air squeeze arrangement 12 for squeezing out air can generally be moved using universally-known mechanisms both in a linear fashion, preferably horizontally and/or vertically, and, generally, along the contour of a segment of a circle.

Figure 2:
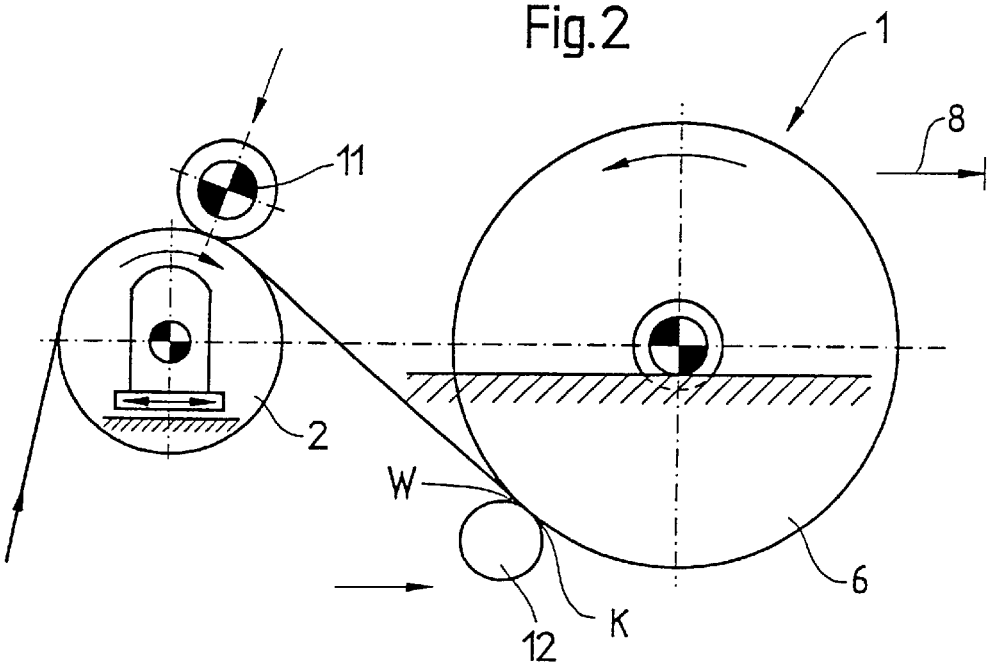
FIG. 2 is a schematic side view of a reeling machine, together with an air squeeze arrangement according to the invention, during the final winding phase.

Referring additionally now to FIG. 2, there is shown a side view of reeling machine 1, during the final winding phase, with air squeeze arrangement 12. During this final winding phase, jumbo roll 6 is moved away from reel drum 2 using the transport mechanism described above with the release of nip 7 and the formation of free web tension. After a time interval, empty reel spool 11, which was previously held at a distance from reel drum 2, is displaced from a holding device, which is not shown, onto reel drum 2 with the consequent formation of nip 7. The winding phase for empty reel spool 11 now begins with the separation of fibrous web 4, which is not shown in the diagram, whereupon nothing more is wound on to jumbo roll 6, which is moved horizontally into a final position (reel spool change position).

Air squeeze arrangement 12 is placed against jumbo roll 6 in front of the opening of nip 7 between reel drum 2 and jumbo roll 6. As soon as active area W has been formed between jumbo roll 6 and air squeeze arrangement 12, effective force K in active area W is controlled through dislocation of air squeeze arrangement 12. A control circuit is familiar to a person of ordinary skill and is known to the applicant in connection with a reel drum from Unexamined German Patent Application DE 198 07 897 A1 (PR10678 DE) cited above. Air squeeze arrangement 12 is displaced to jumbo roll 6 while effective force K is maintained in active area W. Displacement is only complete once jumbo roll 6 is moved horizontally and reached its final position (reel spool change position).

Figure 3:
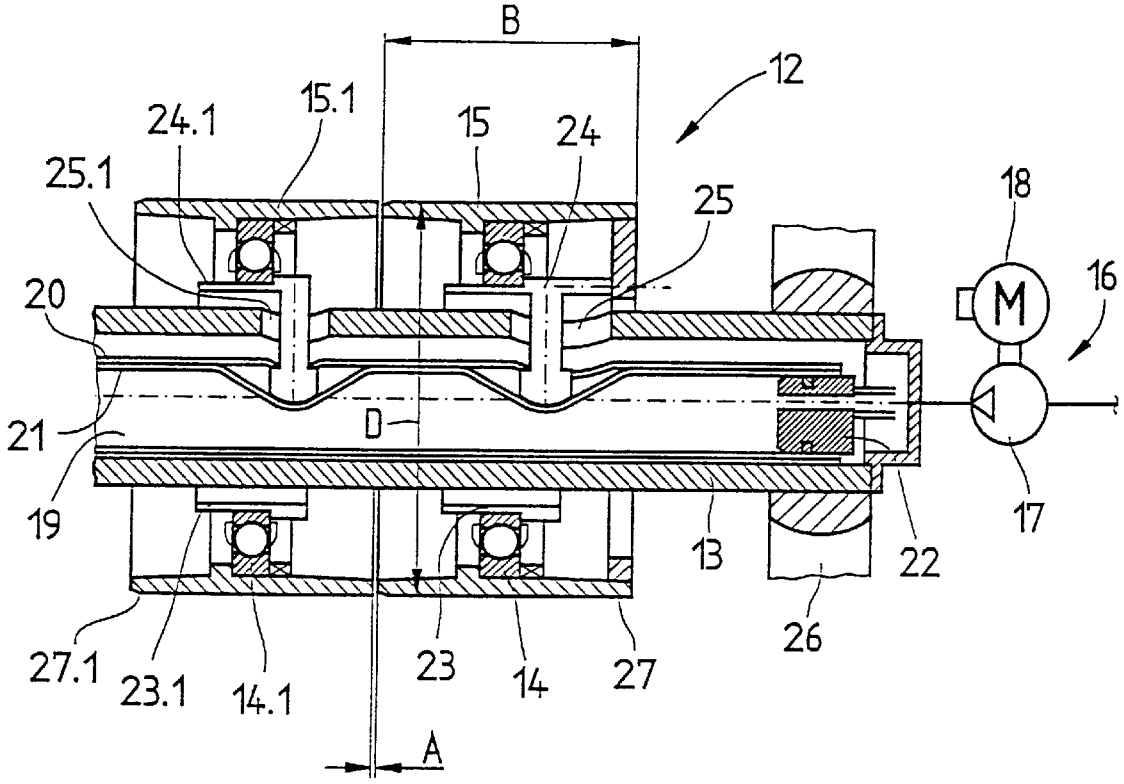
FIG. 3 is a simplified longitudinal section view of the air squeeze arrangement according to the invention.

Now further referring to FIG. 3, air squeeze arrangement 12, is formed from adjustable supporting profile 13 with segment rollers 15 and 15.1 which are eccentrically placed by means of bearings 14 and 14.1, preferably rolling bearings. The interior of supporting profile 13 contains tube 21 which is surrounded by guide pipe 20 and filled with pressure medium 19, preferably a fluid or a gas, from pressure source 16 (pressure pump 17 and electric motor 18) and which is provided with one sealing cap 22 on each side. Non-rotating bearing bushings 23 and 23.1 of bearings 14 and 14.1 are supported centrally and with the capacity for radial displacement on tube 21 by means of power transmission elements 24 and 24.1, respectively, preferably comprised of a plunger. In this process, power transmission elements 24 and 24.11 run through openings 25 and 25.1, preferably drilled holes, in guide pipe 20. Supporting profile 13 is formed from a supporting pipe and is held on both sides in framing 26. Segmented rolls 15 and 15.1 have diameter D of between 200 and 400 mm, preferably between 250 and 350 mm, and width B of between 150 and 400 mm, preferably between 200 and 300 mm. Two segmented rolls 15 and 15.1 placed in immediate proximity to each other with distance A between them of 0.5 to 5 mm, preferably 1.0 to 2.0 mm. Segmented rolls 15 and 15.1 have rubberized and/or grooved surfaces 27 and 27.1. It is also possible for level (even) surfaces 27 and 27.1 to be featured here instead. If surfaces 27 and 27.1 are rubberized then segmented rolls 15 and 15.1 should have a hardness of between 50 and 200 P&J, preferably between 80 and 120 P&J.

Figure 4:
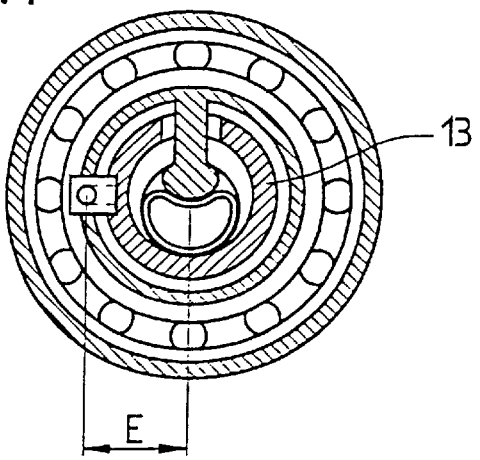
FIG. 4 is a simplified cross-sectional view of the air squeeze arrangement according to the invention.

Now further referring to FIG. 4 air squeeze arrangement 12 is shown in cross-sectional view and the eccentric bedding of supporting profile 13 can be clearly observed. Eccentricity E has a value of between 2 and 20 mm, preferably between 5 and 12 mm.

In conclusion, it should be stated that the invention serves to improve a reeling machine in such a way that the problem of air being trapped between the individual layers of the jumbo roll (due to unevenness in the surface contours of the virtually fully-spooled jumbo roll) is avoided and that the "wound-in" web tension is maintained.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMBERS

1 Reeling machine
2 Reel drum
3 Double-headed arrow
4 Fibrous web
5 Surface shell
6 Jumbo roll
7 Nip
8 Directional arrow
9 Guideway (rail)
10 Reel spool
11 Empty reel spool
12 Air squeeze arrangement
13 Supporting profile
14, 14.1 Bearing
15, 15.1 Segmented roll
16 Pressure source
17 Pressure pump
18 Electric motor
19 Pressure medium
20 Guide pipe
21 Tube
22 Sealing cap
23, 23.1 Bearing bush
24, 24.1 Power transmission element
25, 25.1 Opening
26 Framing
27, 27.1 Surface
A Distance
B Width
D Diameter
E Eccentricity
G Horizontal
K Effective force
L Longitudinal force
S Directional arrow
W Active area

What is claimed is:

1. A reeling machine for continuous winding of a fibrous web into a jumbo roll, comprising:

a reel spool carrying the jumbo roll;

a reel drum located proximate to and forming a nip with the jumbo roll;

a bearing arrangement including at least one transport arrangement and a guideway rail, said at least one transport arrangement configured to guide said reel spool along said guideway rail; and an air squeeze arrangement located in the lower area of said reeling machine, said air squeeze arrangement being capable of being positioned against said jumbo roll, said air squeeze arrangement including: a supporting profile, a plurality of segmented rolls, and a plurality of bearings, said bearings being positioned eccentrically next to each other on said supporting profile and carrying said segmented rolls, said supporting profile including an interior having a tube, a guide pipe surrounding said tube, a pressure medium from a pressure source contained in said tube, and a plurality of power transmission elements, each said power transmission element centrally supporting said tube to the non-rotating bearing bushing of said plurality of bearings.

2. The reeling machine of claim 1, wherein said supporting profile is a supporting pipe.

3. The reeling machine of claim 1, wherein each said power transmission element is a plunger.

4. The reeling machine of claim 1, wherein said pressure medium is at least one of a fluid and a gas.

5. The reeling machine of claim 1, wherein said pressure medium is a hydraulic fluid.

6. The reeling machine of claim 1, wherein each said segmented roll has a diameter and a width.

7. The reeling machine of claim 6, wherein said diameter is between 200 mm and 400 mm.

8. The reeling machine of claim 7, wherein said diameter is between 250 mm and 350 mm.

9. The reeling machine of claim 6, wherein said width is between 150 mm and 400 mm.

10. The reeling machine of claim 9, wherein said width is between 200 mm and 300 mm.

11. The reeling machine of claim 1, wherein said plurality of segmented rolls include a first segmented roll and a second segmented roll, said first segmented roll and said second segmented roll being separated by between 0.5 mm and 5.0 mm.

12. The reeling machine of claim 1, wherein said plurality of segmented rolls includes a first segmented roll and a second segmented roll, said first segmented roll and said second segmented roll being separated by between 1.0 mm and 2.0 mm.

13. The reeling machine of claim 1, wherein the outer surface of each said segmented roll is at least one of rubberized and grooved.

14. The reeling machine of claim 1, wherein the outer surface of each said segmented roll is a rubberized surface, said rubberized surface having a hardness of between 50 and 200 P&J.

15. The reeling machine of claim 14, wherein the outer surface of each said segmented roll is a rubberized surface, said rubberized surface having a hardness of between 80 and 120 P&J.

16. The reeling machine of claim 1, wherein said supporting profile is configured to provide eccentricity of between 2 mm and 20 mm to each said power transmission element.

17. The reeling machine of claim 16, wherein said supporting profile is configured to provide eccentricity of between 5 mm and 12 mm to each said power transmission element.

18. The reeling machine of claim 1, wherein said air squeeze arrangement is positioned against said jumbo roll at the point at which the fibrous web meets the surface of said jumbo roll.

19. The reeling machine of claim 1, wherein said air squeeze arrangement is positioned against said jumbo roll in front of said nip.

20. The reeling machine of claim 1, wherein said air squeeze arrangement is configured to be placed in a linear position, said linear position being one of at least one of horizontal and vertical.

21. The reeling machine of claim 1, wherein said air squeeze arrangement is configured to be positioned along the contour of a circle segment.

22. The reeling machine of claim 1, wherein said air squeeze arrangement is positioned against said jumbo roll thereby forming an active area therebetween, said air squeeze arrangement being configured to regulate the effective force in said active area by a displacement of said air squeeze arrangement.

* * * * *